United States Patent [19]

Haase

[11] 4,401,063

[45] Aug. 30, 1983

[54] FUEL DISTRIBUTION SYSTEM FOR AN INTERNAL COMBUSTION ENGINE

[75] Inventor: Elmer A. Haase, South Bend, Ind.

[73] Assignee: The Bendix Corporation, Southfield, Mich.

[21] Appl. No.: 251,688

[22] Filed: Apr. 6, 1981

[51] Int. Cl.[3] ..... F02B 33/04

[52] U.S. Cl. ..... 123/73 B; 123/73 CB; 123/73 CC; 123/74 R; 123/74 B

[58] Field of Search ..... 123/73 B, 74 R, 74 B, 123/73 CB, 73 CC, 73 R

[56] References Cited

FOREIGN PATENT DOCUMENTS

| | | | |
|---|---|---|---|
| 1,353,288 | 5/1974 | United Kingdom | 123/73 B |
| 1,447,773 | 9/1976 | United Kingdom | 123/73 B |
| 1,538,852 | 1/1979 | United Kingdom | 123/73 B |
| 2,072,744 | 10/1981 | United Kingdom | 123/55 V |

*Primary Examiner*—Wendell E. Burns

*Attorney, Agent, or Firm*—Leo H. McCormick, Jr.; Ken C. Decker

[57] ABSTRACT

A fuel distribution system for an engine (10) having the fuel nozzles (74) located downstream from the air intake reed valves (52) to prevent the operation of the reed valves (52) from effecting the dual flow to the combustion chambers (42) through the transfer tubes (26). A manually operated pump (106) responds to an operator input to add or subtract fuel supplied to a flow divider (98) by a fuel valve (104) to provide a substantially immediate response from the engine to the operator input. A choke (160) receives an input from the engine to allow the mass air flow responsive fuel valve (104) to supply the flow divider (98) with an additional quantity of fuel during a starting operation.

26 Claims, 10 Drawing Figures

FUEL DISTRIBUTION SYSTEM FOR AN INTERNAL COMBUSTION ENGINE

BACKGROUND OF THE INVENTION

This invention relates to a fuel distribution system for an internal combustion engine.

In known vertical shaft internal combustion engines, the fuel nozzles for the individual cylinders are connected to a mixing chamber adjacent the intake valves, in a manner as disclosed in U.S. Pat. No. 4,227,492. During the operation of such internal combustion engines the intake valves open to allow air and fuel to flow into supply chambers on the intake stroke of the pistons and close on the compression stroke of the pistons to prevent the mixture of air and fuel from being expelled back into the mixing chambers.

Normally the intake valves of such internal combustion engines are reed valves. A portion of the fuel-air mixture that must be transmitted to the supply chambers contact the reed valves. Often times at low engine speeds the atomized fuel atoms contact the reed valves and are combined with fuel collected on the reed valves to produce dropplets of fuel. Such dropplets accumulate around the reed valves and should they be drawn into the combustion chamber, the result is too rich a fuel mixture for the operation of the engine. Since some flow of fluid occurs, because the reed valves do not close immediately on movement of the pistons, on the down stroke by the combustion force produced by ignition of the fuel-air mixture in a combustion chamber, a portion of the fuel supplied to operate one chamber is often added to the fuel supplied to an adjacent chamber. This additional fuel in the form of either dropplets or atomized fuel is most noticeable when an internal combustion engine is operating at a low or idle speed. For example, in vertical shaft engines it has been found that the upper combustion chambers receive a leaner fuel-air mixture while the lower combustion chambers receive a richer fuel-air mixture even though both are supplied with the same volume of fuel per cycle of operation. The retention members on the intake manifold disclosed in U.S. Pat. No. 4,227,492 prevents intermingling of fuel between adjacent mixing chambers, however, dropplets of fuel can still be produced through the action of the reed valves engaging in the atomized fuel.

SUMMARY OF THE INVENTION

In the fuel distribution system for an internal combustion engine disclosed by the invention herein, the nozzles for the individual chambers are connected to the cylindrical bores such that only air is communicated through the reed valves or air ports into the supply chambers.

Each nozzle has a housing with a cavity therein. The cavity has an entrance port connected to a fuel valve responsive to the mass air flow through the intake manifold, an accumulator port connected to an accumulator and an exit port connected to the bore of the engine housing. The accumulator is connected to the supply chamber and receives fluid under pressure therefrom on the down stroke of the pistons when the reed valves are closed.

When fuel from the fuel valve is communicated into the cavity, air from the accumulator entrains the atomized fuel and transports the same from the cavity into the bore through the exit port. At this point in time, the piston is starting the up stroke in the cylinder and the air entrained fuel is combined with air from the manifold that flows through the reed valves to create as air fuel mixture for distribution to the combustion chambers through transfer conduits that connect each supply chamber with a corresponding combustion chamber.

In order to aid in starting the internal combustion engine, a choke arrangement is included in the fuel distribution system. The choke arrangement has a housing with a cavity therein. The cavity is connected to the supply chambers through an entrance port and to the fuel valve through an exit port. A plunger in the cavity moves from a closed position to an opened position to allow air from the supply chamber to flow to the fuel valve and modify the effect of the mass air flow and increase the fuel supplied to the nozzles through the fuel valve. After a predetermined time period or when the temperature of the air in the supply chambers or water in a radiator reach a predetermined value, the plunger returns to the closed position to thereafter return the control of the fuel valve to the mass air flow through the manifold.

When the operator desires an immediate response from the engine, fuel flow to the nozzles and ultimately the combustion chambers need to be modified to reflect the desired change in operation of the engine. A pump which has a plunger located in a chamber is connected to the operator input mechanism. During a desired acceleration period, the plunger moves in the chamber to supply the nozzles with an additional quantity of fuel to meet the requested demand. Conversely on deceleration, the plunger moves in the chamber to allow a portion of the fuel to be retained therein rather than being transmitted to the nozzles. Thus, this pump in conjunction with the nozzles provides the modification of fuel to meet an immediate operation demand of the engine.

An advantage of this invention results from the smooth operation of an internal combustion engine at low speeds since each combustion chamber is provided with a substantially identical amount of fuel during each combustion stroke.

Another advantage of this invention results from the direct distribution of fuel to the supply chamber to eliminate the flow of fuel and air through the intake valves.

A still further advantage of this invention is provided by the acceleration-deceleration pump which adds or subtracts fuel supplied to the nozzles in response to an operational input to establish an immediate response from the combustion engine.

It is therefore an object of this invention to provide an internal combustion engine with a fuel distribution system having fuel nozzles for directly supplying fuel to a supply chamber to eliminate fuel flow through the air intake valves.

It is a further object of this invention to provide a fuel distribution system with a choke mechanism connected to an operational supply chamber and a fuel valve for modifying the operation of the fuel valve in order to temporarily increase the fuel ratio in the fuel-air mixture supplied to the combustion chambers during starting and cold operation of an engine.

These advantages and objects should be recognized by one skilled in the fuel metering art from viewing the drawing and reading this specification.

DETAILED DESCRIPTION OF THE INVENTION

Figure 1:
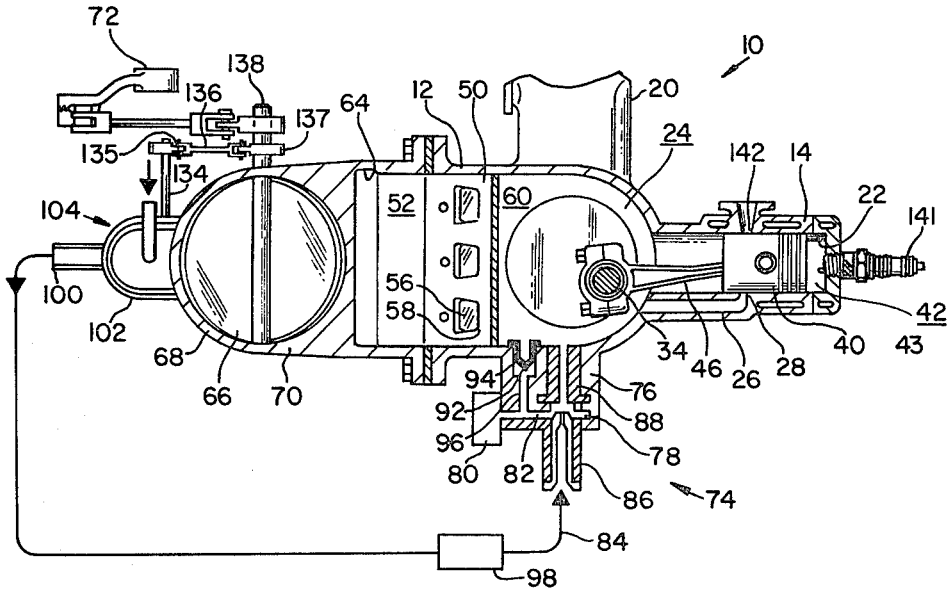
FIG. 1 is a top sectional view of a vertical shaft internal combustion engine having a fuel distribution system made according to the principles of this invention with fuel nozzles connected to the crankcase.
Figure 2:
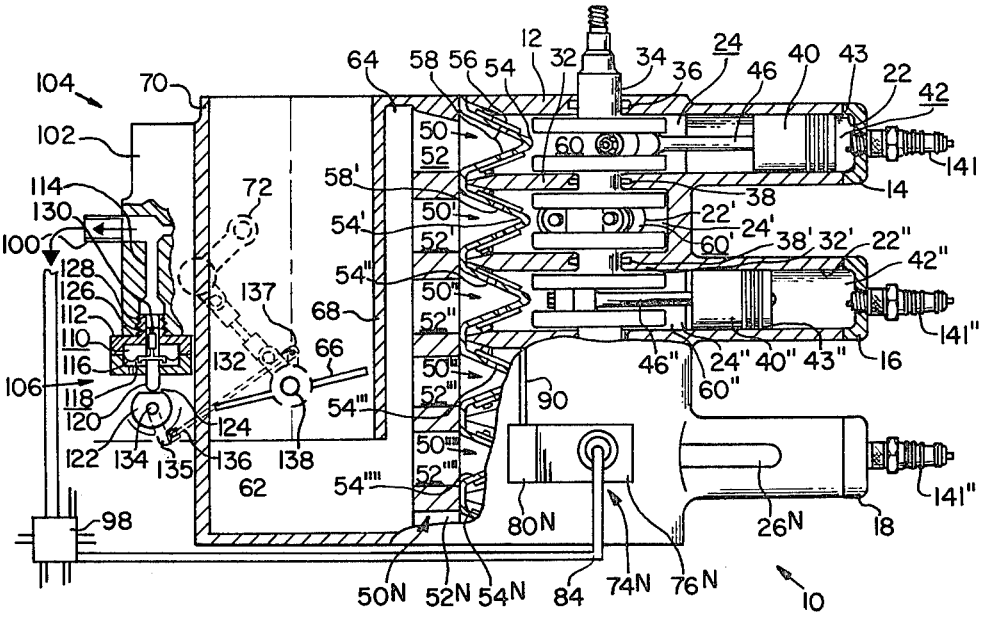
FIG. 2 is a sectional view of a portion of the side of the internal combustion engine of FIG. 1.

The internal combustion engine 10 shown in FIGS. 1 and 2 has a housing 12 with a first bank of cylinders 14, 16, and 18 extending therefrom which are located in a plane substantially 90° from a second bank of cylinders, only 20 of which is shown.

Since each of the cylinders 14, 16, 18, 20, etc. are identical where the same structure is shown in the drawings for the cylinders, the same number with an appropriate ', '', or $^N$ will be used to identify the elements.

Each cylinder has a bore 22, 22' . . . 22$^N$ that extends from a central cavity 24, 24' . . . 24$^N$ in a housing 12 and a transfer tube 26, 26' . . . 26$^N$ that connects each central cavity 24 with a corresponding inlet port 28, 28' . . . 28$^N$ in the bores 22, 22' . . . 22$^N$. Bearing walls 32, 32' . . . 32$^N$ extend from the side wall of housing 12 to separate the individual cavities 24, 24' . . . 24$^N$ from each other. A crankshaft 34 which is perpendicular to the cylinders 14, 16, 18, 20, etc. is fixed to housing 20 by end bearing and seal 36 and to the bearing walls 32, 32' . . . 32$^N$ by bearing seals 38, 38' . . . 38$^N$.

Each cylinder 14, 16, 18, 20, etc. has a piston 40, 40' . . . 40$^N$ that moves in a corresponding bore 22, 22' . . . 22$^N$ to separate the bore into a combustion chamber 42, 42' . . . 42$^N$ and a supply chamber 60, 60' . . . 60$^N$. Each piston 40, 40' . . . 40$^N$ is connected to the vertical shaft 34 by a connecting rod 46, 46' . . . 46$^N$ which is eccentrically located with respect to the axial center of shaft 34 in order that pistons 40, 40'. . . 40$^N$ are sequentially positioned in cylinders 14, 16, 18, 20, etc.

A control valve 50, 50' . . . 50$^N$ is located between a manifold chamber 52, 52' . . . 52$^N$ and cavity 24, 24' . . . 24$^N$. Each control valve 50, 50' . . . 50$^N$ has corrugated sections 54, 54' . . . 54$^N$ with a series of reeds or flappers 56, 56' . . . 56$^N$ located over openings 58, 58' . . . 58$^N$. The individual corrugated sections extend into cavity 24, 24' . . . 24$^N$ and with housing 20 and side wall 32, 32' . . . 32$^N$ define the supply chamber 60, 60' . . . 60$^N$ for each cylinder 14, 16, 18, 20, etc.

The individual manifold chambers 52, 52' . . . 52$^N$ are connected to a common air chamber 62 by a passage 64. A butterfly valve 66 is located in the throat section 68 of housing 70 to control the flow of air into the air chamber 62 as a function of the position of the input lever 72.

Each supply chamber 60, 60' . . . 60$^N$ has a fuel nozzle 74, 74' . . . 74$^N$ attached thereto through which fuel from a source is supplied to the combustion chamber 42, 42' . . . 42$^N$.

Each fuel nozzle 74, 74' . . . 74$^N$ has a housing 76 that is attached to housing 12. As best shown in FIG. 1, each housing 76 has a mixing chamber 78 which is connected to an accumulator 80 through a passage 82, to the fuel supply conduit 84 through first injector 86 and to the supply chamber 60 through a second injector 88. The accumulator 80 . . . 80$^N$ are interconnected to each other through a conduit 90 and to the supply chambers 60, 60' . . . 60$^N$ through corresponding passages 92, 92' . . . 92$^N$ in housings 76, 76' . . . 76$^N$. Check valves 94, 94' . . . 94$^N$ located in each passage 92, 92' . . . 92$^N$ prevent the flow of fluid from accumulators 80, 80' . . . 80$^N$ into supply chambers 60, 60' . . . 60$^N$. However, a slit 96, 96' . . . 96$^N$ located in the end of each check valve 94, 94' . . . 94$^N$ allows fluid communication from supply chambers 60, 60' . . . 60$^N$ into the accumulators 80, 80' . . . 80$^N$.

A flow divider 98 of the type fully disclosed in U.S. Pat. No. 3,114,359 is connected to the outlet port 100 in housing 102 of a fuel control valve 104 of the type fully disclosed in U.S. Pat. No. 4,228,777. The flow divider 98 sequentially supplies each injector 86, 86' . . . 86$^N$ with substantially equal volumes of fuel for distribution to the combustion chambers 42, 42' . . . 42$^N$. In addition, a manually activated pump 106, as best shown in FIG. 2, is located between the control valve 104 and flow divider 98 to modify the fuel flow to the combustion chambers 42, 42' . . . 42$^N$ in response to an input from the operator through the power lever 72.

The pump 106 has an end plug 112 attached to housing 102 to form a chamber 110 adjacent passage 114. Chamber 110 is separated from an atmospheric chamber 118 by a diaphragm 116. A plunger 120 which extends through the end plug 112 has a first end 124 which engages a cam 122 and a second end 126 that engages bearing surface 128. A bore 130 located in the second end 126 of plunger 120 and openings 132 allows fluid to freely flow between chamber 110 and passage 114. A lever 135 attached to shaft 134 that carries cam 122 is connected by linkage 136 to a lever 137 on shaft 138 on the butterfly valve 66. Through this diaphragm 116, cam 122 and linkage 136, the pump 106 responds to acceleration and deceleration fuel flow conditions to match the operation of engine 10 with the input supplied by an operator to lever 72.

MODE OF OPERATION OF THE INVENTION

The vertical shaft 34 in the internal combustion engine 10 shown in FIGS. 1 and 2 is provided with rotary motion through the linear movement of pistons 40, 40' . . . 40$^N$ in cylinders 14, 16, 18, 20, etc. The connecting rods 46, 46' . . . $46^N$ associated with pistons 40, 40' . . . $40^N$ are attached to shaft 34 such that when one piston is at the top of its intake stoke, another piston is at the bottom of its compression stroke and the remaining pistons are proportionally located in between the top and bottom of their respective strokes. On each intake or up stroke for each piston 40, a fixed quantity of fuel is supplied to the mixing chamber 78 through the injector 86 from the flow divider 98. When fuel is transmitted into mixing chamber 78, air from accumulator 80 is communicated through passge 82 to entrain this fuel in chamber 78. The air entrained fuel passes from mixing chamber 78 through injector 88 into the supply chamber 60 and is mixed with air that flows through the reed valves 54 from air chamber 62 in the manifold. When piston 40 reaches the top of its stroke, as shown in FIG. 2, the fuel-air mixture in combustion chamber 42 is compressed to a predetermined volume. Thereafter, spark plug 141 is provided with an electrical charge which causes the fuel-air mixture to ignite and provide a combustion force that moves piston 40 toward the supply chamber 60.

When piston 40 moves toward the supply chamber 60, the combustion chamber 42 expands and when piston 40 moves past exhaust port 142 the combusted mixture of exhaust gases flows to the surrounding environment. At the same time the fluid in the supply chamber 60, which is mostly air, is compressed as the reed or flapper valves 54 close. The fluid pressure build-up in the supply chamber 60 causes air to flow past check valve 94 into accumulator 80.

The charge of fuel from divider 98 flows through injector 86 into mixing chamber 78 and is entrained with air from accumulator 80. The air entrained fuel flows through the second injector 88 into the supply chamber 60. The flow of air entrained fuel into the supply chamber is mixed with the air in the supply chamber 60 and thereby establish a desired fuel air mixture. When piston 40 moves past the lip of inlet port 28, the fuel air mixture flows through the transfer tube 26 into the combustion chamber 42 and displaces the combusted mixture as it flows out of the engine. When piston 40 reaches the bottom of its stroke, a set charge of the combustible mixture having a selected fuel-to-air ratio has been communicated into the combustion chamber 60. Thereafter, piston 40 moves toward the combustion chamber 42. As piston 40 moves from the bottom of its stroke, the pressure in the supply chamber 60 drops and when lip 43 on piston 40 reaches the inlet port 28, the pressure in the supply chamber 60 and combustion chamber 42 are substantially equal. As the piston 40 moves past the inlet port 28 and exhaust port 142 the pressure in the supply chamber is lowered causing the reed or flapper valves 54 to open and allow air from air chamber 62 to enter the supply chamber 60 until piston 40 reaches the top of its stroke where ignition occurs to complete a cycle of operation for shaft 34.

The combustion force of the fuel-air mixture in each chamber 42, 42' . . . $42^N$ acts on pistons 40, 40' . . . $40^N$ associated therewith to provide a linear force which causes the vertical shaft 34 to rotate at a substantially uniform angular speed. Since the speed of the vertical shaft can vary from a few hundred revolutions per minute to several thousand revolutions per minute in order for this angular speed to be uniform, it is necessary that the same fuel-to-air ratio be maintained in each cylinder 14, 16, 18, 20, etc. Since the injector 88 of nozzle 74 is downstream from the reed valves 54 the atomized fuel is not effected by the opening or closing of the reeds 54. Thus, the volume of fuel supplied to each cylinder 14, 16, 18, 20, etc. from the flow divider 98 remains substantially constant at all speeds.

When an operator desires to accelerate the engine 10, the power lever 72 is moved to change the position of butterfly valve 66 and allow more air to flow through the manifold and correspondingly change the fuel flow through the fuel valve 104. As the butterfly valve 66 moves from one position to the desired acceleration position linkage 136 rotates cam 122 to move diaphragm 116 and displace fuel from chamber 110 to the supply conduit 100 for distribution to flow divider 98. This additional fuel, which is equally divided among the cylinders 14, 16, 18, 20, etc. by the flow divider 98, allows the engine 10 to immediately react to an acceleration request by the operator. In addition should the operator move the power lever 108 from an operating position to a deceleration position the butterfly valve 66 is closed to reduce the air flow through the manifold and correspondingly the fuel flow to cylinders 14, 16, 18, 20, etc. As the butterfly valve 66 moves linkage 136 rotates cam 122 to allow diaphragm 116 to move toward atmospheric chamber 118 and expand chamber 110. When chamber 110 is expanded fuel from the fuel valve 104 is diverted thereto through passage 114 rather than going to flow divider 98. Thus, the fuel that cylinders 14, 16, 18, 20, etc. received is proportionally reduced and engine 10 immediately responds to the deceleration input.

Figure 3:
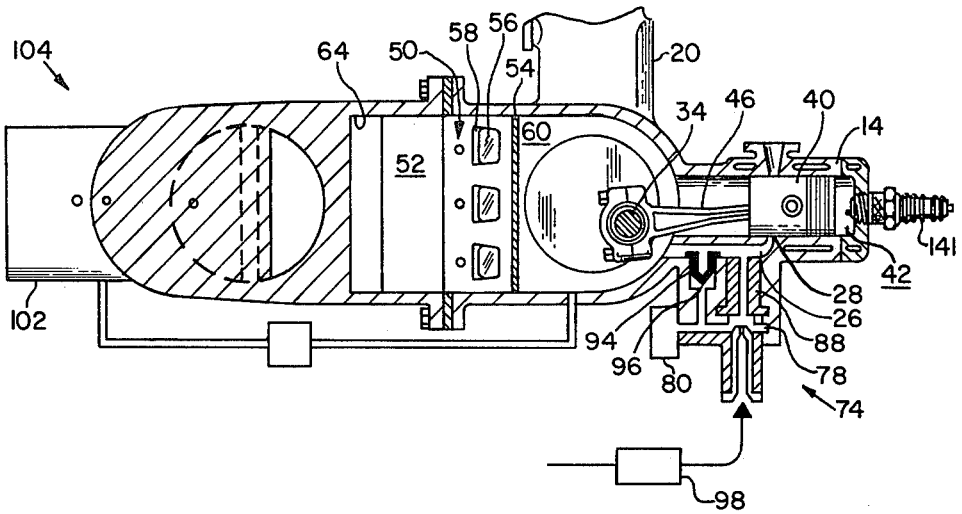
FIG. 3 is a top view of an internal combustion engine having a fuel distribution system made according to the principles of this invention whereby the fuel nozzles are connected to transfer tubes that supply air from the crankcase to the combustion chambers.

Under some operational conditions it may be desirable to locate the nozzles 74 closer to the entrance port 28. As shown in FIG. 3, the injector 88 is connected to the transfer tube 26. Since the fluid pressure in the accumulators 80 . . . $80^N$ is substantially constant through the interconnection of the supply chambers 60, 60' . . . $60^N$ by conduit 90, when piston 40 passes entrance port 28 air flow is initiated to the combustion chamber 42 through mixing chamber 78, injector 88 and transfer tube 26. When fuel is presented from the flow divider 98 it is entrained in the mixing chamber 78 and flows through the injector 88 to the transfer tube. By this time, the air in the supply chamber 60 is being pressurized by the movement of piston 40 toward the supply chamber 60 since the reed or flapper valves 52 are closed. The pressurized air in the supply chamber 60 flows through the transfer tube 26 and is mixed with the air entrained fuel flowing from injector 88 to establish a predetermined fuel-air ratio for operating the engine. A portion of this pressurized air flows through check valve 94 into the accumulator 80 to replenish that air that is used to entrain the fuel for distribution to the cylinders 14, 16, 18, 20 etc.

The delivery of fuel to the combustion chambers 14, 16, 18, 20, etc. is controlled by the fuel valve 104 of the type fully disclosed in U.S. Pat. No. 4,228,777 and schematically illustrated in FIG. 4. Changes in the position of the butterfly valve 66, change the mass air flow to the air chamber 62 and static pressure as measured in the throat 63 of the manifold. The air diaphragm 103 and fuel diaphragm 105 respond to an air pressure differential between chambers 107 and 109 and a fuel pressure differential between chambers 111 and 113. When the air pressure differential and fuel pressure differential are balanced, ball 115 is positioned away from seat 117 such that the fuel flow through outlet 100 is sufficient to operate the engine in a manner consistent with the setting of power lever 72.

Since the fuel flow to the flow divider 98 is dependent on the mass air flow through the manifold, on starting the engine 10, the mass air flow goes from zero to the air flow generated through the movement of the piston 40, 40' . . . 40$^N$ by the rotation of shaft 34 by a starter (not shown). During some starting conditions such as in cold weather, it may be desirable to have a richer fuel-to-air ratio than would normally be provided. To temporarily achieve an increase in fuel in the fuel-air ratio supplied to the cylinders 14, 16, 18, 20, etc., a choke mechanism is connected to the fuel valve 104. During a choke operation the same fluid pressure presented the accumulator 80 is communicated through a valve 160 or bleed circuit or conduit 168 to atmospheric chamber 107 of the fuel valve 104. The fluid pressure from accumulator 80 is used to falsify the signal supplied to the fuel valve 104 to create a richer fuel-to-air ratio. Actuation of valve 160 can be achieved through the use of hot air, time, water temperature or manually.

Figure 4:
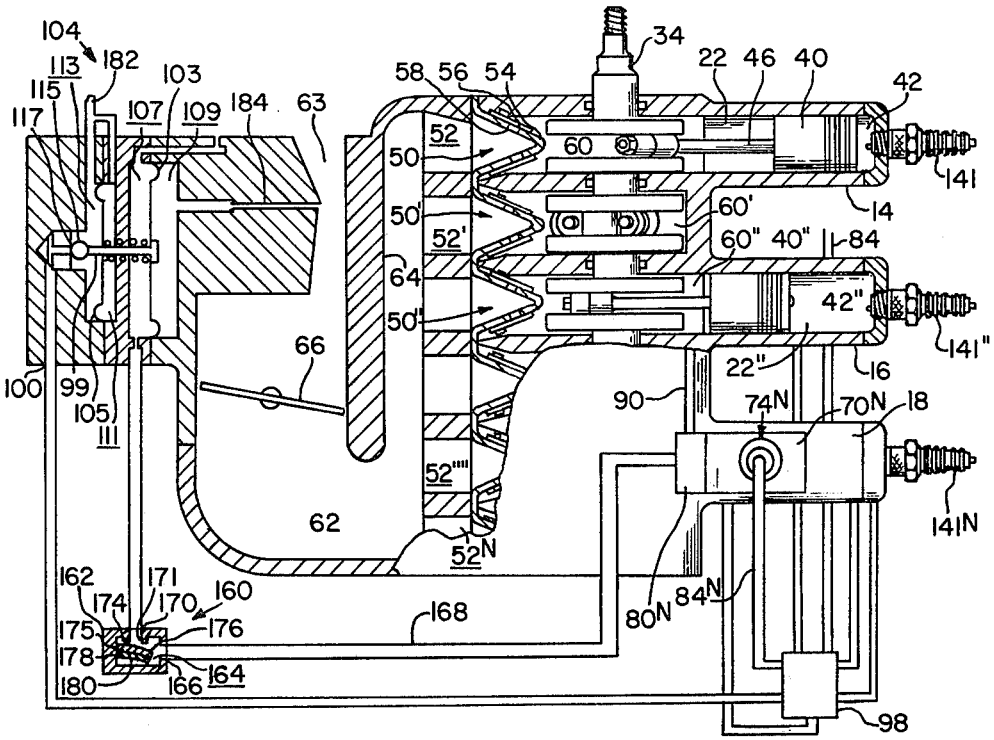
FIG. 4 is a sectional view of a portion of the side of the internal combustion engine of FIG. 3.

In the choke mechanism shown in FIG. 4, hot air is the actuation medium for valve 160. Valve 160 has a housing 162 with a chamber 164 located therein. Chamber 164 has an inlet port 166 connected to the accumulator 80 by a conduit 168 and an outlet port 170 connected to atmospheric chamber 107 in the fuel valve 104 by a conduit 172. A first strip of metal 174 which has a first end 175 fixed to the housing 162 and a second end 176 that extends into chamber 164. A second strip of metal 180 has a first end 178 fixed to the housing 162 and a second end that extends into chamber 164. The first and second strips of metal 178 and 180 which are of different metals having different coefficient of expansion and contraction when heated are joined together to form a bi-metal strip.

The engine 10 is shown in FIG. 4 as being in the inoperative or off state. The bi-metal strip is shown with strip 180 in the contracted state while strip 174 is in an expanded state. Under these circumstances, free fluid communication exists between the inlet port 166 and outlet port 170.

When an operator desires to start engine 10 shown in FIG. 4, fuel from a source is presented to the fuel valve 104 through conduit 182. Since the mass air flow through the throat is zero, ball 115 remains seated on seat 117. When the starter provides shaft 34 with a rotary input, pistons 40, 40' . . . 40$^N$ move in cylinders 14, 16, 18, 20, etc. to draw air into the supply chambers 60, 60' . . . 60$^N$ through the manifold to develop a mass air flow signal that is communicated through passage 184 to chamber 109. The pressure in chambers 107 and the sensed mass air flow signal in chamber 109 produce a pressure differential that acts on diaphragm 103 to provide an input that moves ball 115 away from seat 117 and allows fuel to flow to divider 98 for distribution to cylinders 14, 16, 18, 20, etc. through nozzles 74 . . . 74$^N$. The supply fluid pressure developed in the supply chambers 60, 60' . . . 60$^N$ on movement of the pistons 40, 40' . . . 40$^N$ toward the supply chambers 60, 60' . . . 60$^N$ is communicated to accumulator 80 and through conduit 168 to chamber 107. The supply fluid pressure is added to the atmospheric pressure to increase the pressure differential across diaphragm 103 and thereby move ball 115 further away from seat 117 than occurs when only the mass air flow is used to control the position of the plunger 99 in the fuel valve 104. With ball 115 further away from seat 117 more fuel flows to the flow divider 98 and thus the fuel-air ratio supplied to cylinders 14, 16, 18, 20, etc. is increased. Once the engine 10 is started, the ignition of fuel in the combustion chambers 42, 42' . . . 42$^N$ increases the temperature in housing 12. The air flowing through the supply chambers 60, 60' . . . 60$^N$ is heated by conduction of the thermal energy generated in the combustion chambers 42, 42' . . . 42$^N$. This heated air is transmitted from accumulator 80 through conduit 168 and acts on the bi-metal strip to move strip 174 into contact with seat 171. With strip 174 in contact with seat 171, the supply fluid pressure to chamber 107 is interrupted and the operation of fuel valve 104 thereafter is controlled by the mass air flow through the manifold. The strength of the bi-metal strip is such that the fluid pressure of fluid in the supply chambers to, 60' . . . 60$^N$ which is communicated to chamber 164 acts thereon and holds strip 174 adjacent seat 171 to assure that only the mass air flow through the manifold controls the fuel flow from the fuel valve 104.

Figure 5:
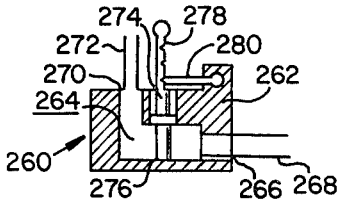
FIG. 5 is a sectional view of a manual choke mechanism for the fuel distribution system of FIG. 3.

In some installations the control of choke mechanism by thermal energy may be inadequate. An economical control may be a manually controlled fuel valve 260 as shown in FIG. 5.

In manual fuel valve 260, the housing 262 has a chamber 264 that is connected to the accumulator 80 by a conduit 268 and to chamber 107 by a conduit 272. A plunger 274 located in a groove 276 has notches or detents 278 on the end thereof. A leaf spring 280 has a first end fixed to the housing 262 and a second end that engages the detents 278 on plunger 274. On starting the engine 10, when the operator desires to increase the fuel-to-air ratio, plunger 274 is moved to a position such that fluid communication is allowed between the inlet port 266 and outlet port 270. Thereafter, the fluid pressure generated in the supply chambers 60, 60' . . . 60$^N$ and supplied to accumulator 80 is communicated to chamber 107 in the fuel valve 104 to modify the mass air flow pressure differential across diaphragm 103 and permit an additional quantity of fuel to flow to the flow divider 98 than is normal for such mass air flow at that particular setting of butterfly valve 66. This additional fuel is proportionally supplied to the cylinders 14, 16, 18, 20, etc. to increase the fuel-to-air ratio in the combustion chambers 42, 42' . . . 42$^N$ and thus is starting the engine 10. When engine 10 is operating after a warm-up period, the operator moves plunger 274 to interrupt fluid communication between the inlet port 266 and outlet port 270. Thereafter, the mass air flow through the manifold controls the fuel flow to the flow divider 98. As long as the operator remembers to return the manual fuel valve 260 to the inactive position after warm-up, the designed fuel efficiency of engine 10 should be achieved. However, often times an operator may forget to close the plunger 274 resulting in wasted fuel. This shortcoming can be overcome through the fuel valve 360 shown in FIG. 6 which automatically returned after a set time period.

Figure 6:
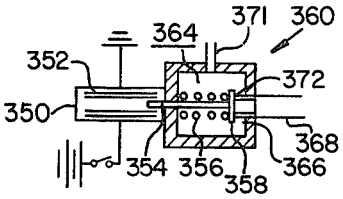
FIG. 6 is a sectional view of an electronic choke mechanism for the fuel distribution system of FIG. 3.

The automatic fuel valve 360 shown in FIG. 6 is operated by a timed electrical signal supplied to solenoid valve 350. The automatic fuel valve 360 has a housing 362 with a chamber 364 located therein. Chamber 364 is connected to the supply chambers 60, 60' . . . 60$^N$ by a conduit 368 and to atmospheric chamber 107 in the fuel valve 104 by a conduit 371. The solenoid valve 350 has a coil 352 connected to an electrical timer (not shown) with a plunger 354 located in the axis of the coil 352. A spring 356 urges head 358 of the plunger 354 toward seat 372 surrounding entrance port 366 to chamber 364.

When the operator turns on the ignition to start the engine 10, electrical energy is supplied to coil 352. With electrical energy flowing through coil 352 a magnetic field is produced that moves plunger 354 to the center thereof by overcoming spring 356. When plunger 354 moves, head 358 disengages seat 372 to allow free communication of the fluid pressure developed in supply chambers 60, 60' . . . 60$^N$ and supplied to accumulator 80 to be communicated to chamber 107 in fuel valve 104. With the supply chamber pressure in chamber 107 and the mass air flow signal communicated to chamber 109, a modified pressure differential is created across diaphragm 103 that causes head 115 to move away from seat 117 and permit fuel to flow to flow divider 98. The flow divider 98 supplies the cylinders 14, 16, 18, 20 with fuel through nozzles 74, 74' . . . 74$^N$. The starting fuel-to-air ratio is greater than the most efficient fuel-to-air ratio for operating the engine 10 and aids in starting the engine 10.

After a preset time, the electrical energy supplied to coil 352 terminates and spring 356 urges head 358 against seat 372 to thereafter prevent fluid communication between the inlet port 366 and the outlet port 371. Thereafter, the mass air flow through the manifold is suppied the fuel valve 104 with an operational signal to control the fuel flow to the flow divider 98 for distribution to the cylinders 14, 16, 18, 20, etc. through nozzles 74, 74' . . . 74$^N$.

Figure 7:
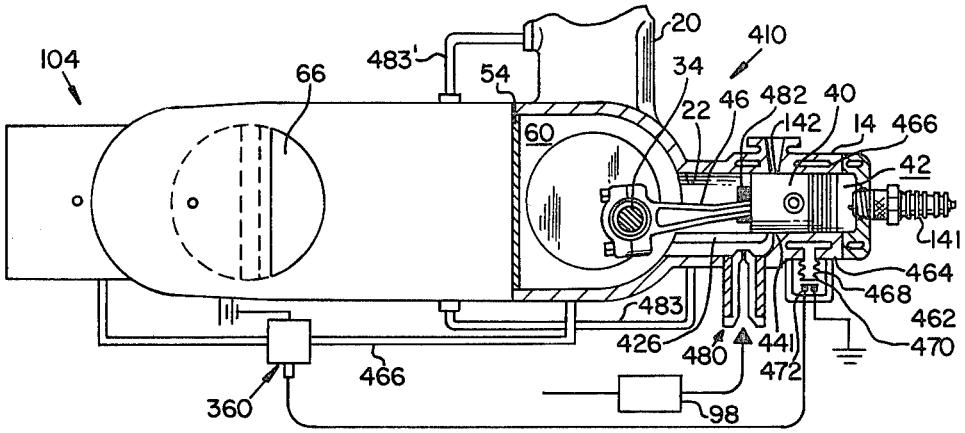
FIG. 7 is a top sectional view of an internal combustion engine with a fuel distribution system made according to the principles of this invention located down stream of the air intake ports to the combustion chamber.

The automatic fuel valve 360 shown in FIG. 7 is controlled by a thermostat 462 connected to water jacket 464 in housing 14.

On starting engine 10, the solenoid 350 of fuel valve 360 receives an electrical signal that opens the flow communication path between chamber 60, 60' . . . 60$^N$ and chamber 107 through conduit 466 to falsify the signal to fuel valve 104 and create a richer fuel-air ratio. As the coolant in water jacket 464 circulates in passage 466 the temperature thereof is raised as the engine warms. Bellows 468 expands as the coolant temperature raises and at a preset temperature contact 470 engages contact 472 to interrupt the flow of electrical energy to solenoid 350 and interrupt fluid communication from supply chamber 60 to chamber 107 through conduit 466.

Thereafter, the mass air flow through the manifold supplies the fuel valve 104 with an operational signal to control the fuel flow to the flow divider 98 for distribution to cylinders 14, 16, 18, 20, etc. through nozzles 480, 480' . . . 480$^N$.

It should be understood that the nozzles 74, 74' . . . 74$^N$ are disclosed as having continuous flow however, it is anticipated that intermittent flow could be achieved through the use of a timing solenoid.

In order to confirm that the operational performance of the engine 10 was improved by locating the nozzles 74, 74' . . . 74$^N$ downstream from the air intake valves 52, 52' . . . 52$^N$, solid flow nozzles 480, 480' . . . 480$^N$ were directly connected to the transfer tubes 26, 26' . . . 26$^N$. No detectible difference was observed at low speed and when the power lever 72 was rapidly moved to accelerate the engine, the speed of the engine uniformly increased to the desired operational level.

In engine 410 shown in FIG. 7, the air intake ports 482, 482' . . . 482$^N$ which are located in cylinders 14, 16, 18, 20, etc., are connected to the air intake manifold by conduits 483, 483' . . . 483$^N$.

Figure 8:
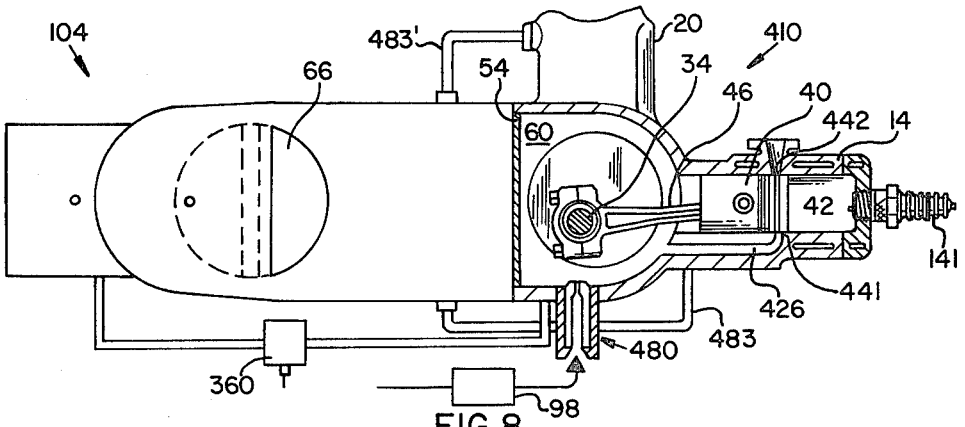
FIG. 8 is a top sectional view of an internal combustion engine having an intake port closed by movement of an operational piston.

On the intake stroke, pistons 40, 40' . . . 40$^N$ move past intake ports 482, 482' . . . 482$^N$ to allow air to be communicated into chambers 60, 60' . . . 60$^N$. At the top of the intake stroke, spark plugs 141, 141' . . . 141$^N$ are supplied with an electrical charge to ignite the fuel-air mixture in combustion chambers 42, 42' . . . 42$^N$. Ignition of the fuel-air mixture in combustion chamber 42, 42' . . . 42$^N$ cause pistons 40, 40' . . . 40$^N$ to move toward air supply chamber 60. When pistons 40, 40' . . . 40$^N$ move past intake ports 482, 482' . . . 482$^N$ as shown in FIG. 8, air flow to supply chambers 60, 60' . . . 60$^N$ is interrupted and the pressure of air and fuel therein is raised. As pistons 40, 40' . . . 40$^N$ move toward chamber 60, 60' . . . 60$^N$ fuel and air is communicated into combustion chambers 42, 42' . . . 42$^N$ through transfer tubes 426, 426' . . . 426$^N$. After pistons 40, 40' . . . 40$^N$ move past exhaust ports 442, 442' . . . 442$^N$ combusted gases flow out of the combustion chamber 42, 42' . . . 42$^N$. In addition, the flow of fuel and air mixture into the combustion chambers 42, 42' . . . 42$^N$ through transfer tubes 426, 426' . . . 426$^N$ aid in the removal of the combusted gases.

At the end of the exhaust stroke, pistons 40, 40' . . . 40$^N$ moves toward the combustion chambers 42, 42' . . . 42$^N$. After piston moves past inlet ports 441, 441' . . . 441$^N$ and exhaust ports 442, 442' . . . 442$^N$, the fuel air mixture in the combustion chambers 42, 42' . . . 42$^N$ is compressed. At the same time the fluid pressure in chambers 60, 60' . . . 60$^N$ is lowered and when pistons 40, 40' . . . 40$^N$ move past inlet ports 482, 482' . . . 482$^N$, air is drawn into chambers 60, 60' . . . 60$^N$ to complete a cycle of operation.

It should be pointed out in engine 410, shown in FIGS. 7 and 8, the movement of pistons 40, 40' . . . 40$^N$ function to open and close the intake ports 482, 482' . . . 482$^N$ to alow communication of air to chambers 60, 60' . . . 60$^N$ thus eliminating the need for reed valves as shown in engine 10 shown in FIGS. 1 and 3.

In engine 410 shown in FIG. 8, the nozzles 480, 480' . . . 480$^N$ are located in chambers 60, 60' . . . 60$^N$. In this location, the mixing of the fuel from the nozzles 480, 480' . . . 480$^N$ and air from the intake ports 482, 482' . . . 482$^N$ takes place in the supply chambers 60, 60' . . . 60$^N$ rather than in the transfer tubes 426, 426' . . . 426$^N$ No noticeable operation difference for this engine was detectable with this change in nozzle location.

Figure 9:
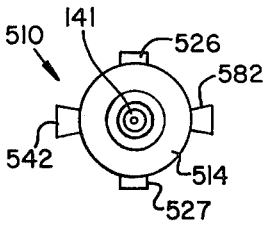
FIG. 9 is an end view of a cylinder of an internal combustion engine showing the relationship of the intake, exhaust and transfer tubes.

In the engine 510 shown in FIG. 9 the air intake tube 582 from the manifold chamber 62 is located external to the cylinder 514. The fuel nozzle, not shown, is connected to the supply chamber, not shown. As in the engine 410 shown in FIG. 7 and 8, the operational piston in this engine 510 moves past the intake port, transfer ports and exhaust ports for communicating fuel and air into the combustion chamber. Because of the normal operational speed that the shaft is required to operate, it is desirable that fuel-air mixture is presented to the combustion chamber as rapidly as possible without changing the ratio therein. It was discovered that the addition of transfer tubes 526 and 527 located on opposite sides of the cylinder 514 and at approximately 90° to the intake 582 and exhaust ports 542 provide such a fuel distribution system.

Figure 10:
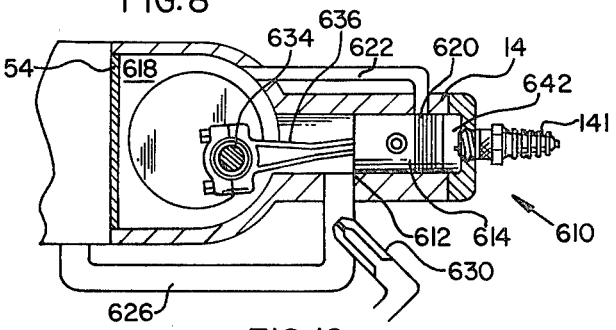
FIG. 10 is a schematic of an internal combustion engine showing an air-intake tube and transfer tube for communicating fuel to a combustion chamber contained therein.

In the schematic of an internal combustion engine 610 shown in FIG. 10, air intake and fuel intake are combined in a single port 612.

When piston 614 moves pasts lip 616 of port 612, air and fuel enter chamber 618. When piston 614 moves past transfer port 620 the fuel mixture is communicated from chamber 618 through transfer tube 622 into chamber 642.

The movement of piston 614 controls the flow of fuel and air into the supply chamber 618 and combustion chamber 642. Since engine 610 is designed to operate at high speed, it is essential that all fuel from a source enters chamber 618 therefore nozzle 630 is located adjacent port 612. In this manner air from the manifold chamber 62 that is communicated through conduit 626 provides aspiration to assure that the fuel from nozzle 630 is delivered to chamber 618. Should any atomized fuel be broken down through the engagement with end 632 of piston 614, the action of shaft 634 and connecting rod 636 in chamber 618 re-establishes the mixing and assures that each combustion chamber 642 of the engine receives substantially the same ratio of fuel air mixture.

Thus, the fuel distribution systems disclosed herein provide an engine with the structure to operate uniformly at low speed and immediately respond to an operator acceleration/deceleration input to change speed when the fuel is introduced in the distribution system downstream from the air intake.

I claim:

1. In a two stroke cycle internal combustion engine having a housing with a series of bores therein, said bore having an entrance port and an exhaust port, a piston located in each bore for separating a supply chamber from a combustion chamber located therein, transfer conduits for connecting each supply chamber with a corresponding combustion chamber, a manifold system connected to said supply chambers, a control valve associated with each supply chamber for allowing air to flow into said supply chamber on movement of the piston toward the combustion chamber and for preventing communication from the supply chamber on movement of the piston toward the supply chamber, the improvement comprising:

a series of housings, each of which has a mixing chamber located therein, a first nozzle connected to a source of fuel and said mixing chamber, a second nozzle through which the mixing chamber is connected to the entrance port, and an accumulator system connected to said supply chambers and each of said mixing chambers, the air in each of the supply chambers being compressed on movement of the pistons toward the supply chambers to raise the fluid pressure of the air therein, a portion of the air under pressure being communicated from the supply chambers into the accumulator system to maintain the fluid pressure therein at a substantially constant level, the air in the accumulator system flowing into said mixing chambers entering the fuel supplied thereto through the first nozzles before being presented to the entrance ports through the second nozzles.

2. In the internal combustion engine as recited in claim 1 wherein said second nozzles in each of said series of housing are connected to the supply chambers, said air entrained fuel being combined with air in the supply chamber to create a substantially uniform air-fuel mixture for distribution to the combustion chambers through the entrance ports.

3. In the internal combustion engine as recited in claim 1 wherein second nozzles in each of said series of housings are to said transfer conduits, said air entrained fuel being combined in said transfer conduit with air from the supply chamber to create a substantially uniform air-fuel mixture for distribution to the combustion chambers through the entrance ports.

4. In the internal combustion engine as recited in claim 2 wherein said distribution means further includes:

check valves located between the supply chambers and accumulator system to prevent fluid from flowing from the accumulator system into the supply chamber to assure that all air flow from the accumulator system to the entrance ports occurs through said mixing chambers.

5. In the internal combustion engine as recited in claim 1 wherein said distributing means further includes:

a pump responsive to an operator input for adding a quantity of fuel to that supplied said first nozzles during a predetermined rate of acceleration and for subtracting a quantity of fuel from that supplied said first nozzles during a predetermined rate of deceleration to provide for a substantially immediate response in the operation of the internal combustion engine.

6. In the internal combustion engine as recited in claim 1 wherein said distribution system further includes:

fuel valve means responsive to the mass air flow through said manifold system for controlling the flow of fuel to said first nozzles; and choke means connected to said supply chambers and fuel valve means for modifying the effect of the mass air flow on the fuel valve means to increase the fuel in the fuel-air ratio mixture supplied to said entrance ports until a predetermined performance is achieved by the internal combustion engine.

7. In the internal combustion engine as recited in claim 6 wherein said choke means includes:

a housing having a cavity therein with a first port connected to said supply chambers and a second port connected to said fuel valve means, said first port being separated by a valve seat;

a first metal member having a first end secured to said housing adjacent said valve seat and a second end; and a second metal member secured to said first metal member, said air in said supply chamber being communicated through said cavity to said fuel valve means to provide said modification of the mass air flow on the fuel valve means, said air flowing through the cavity heating the first and second metal members, said first and second metal members responding to the temperature of the air by moving with respect to said seat to restrict the flow of air through said cavity and reduce said modification of the mass air flow on the fuel valve.

8. In the internal combustion engine as recited in claim 7 wherein said fluid pressure of the air in said supply chambers and communicated to said housing through said first port acts on said second metal strip to aid in urging said first metal strip toward said seat to completely interrupt the flow of air to the fuel valve means and thereafter allow the mass air flow to control the fuel supplied to said first nozzles.

9. In the internal combustion engine as recited in claim 1 wherein said distribution system further includes:

fuel valve means responsive to the mass air flow through said manifold system for controlling the flow of fuel to said first nozzles; and choke means connected to said supply chambers and said fuel valve means for modifying the effect of the mass air flow on said fuel valve means as a function of the fluid pressure of the air in said supply chambers to increase the flow of fuel supplied to said first nozzles and correspondingly the fuel-air ratio supplied said combustion chambers.

10. In the internal combustion engine as recited in claim 9 wherein said choke means includes:

a housing having a cavity therein with an entrance port and an exit port, said entrance port being connected to said supply chambers and said exit port being connected to said fuel valve means; and plunger means having a face member located in said cavity, said face member being movable within said cavity between an opened position where pressurized air from the supply chambers flows to the fuel valve means to modify the effect of the mass air flow to a closed position where the mass air flow primarily controls the flow of fuel to said first nozzles.

11. In the internal combustion engine as recited in claim 10 wherein said plunger means further includes:

a solenoid having a stem connected to said face member, said solenoid receiving a timed electrical signal to temporarily hold said face member in said opened position.

12. In the internal combustion engine, as recited in claim 10 wherein said plunger means further includes:

a stem connected to said face member, said stem having detents thereon; and latch means for engaging one of said detents to hold the face member in a position selected by the operator corresponding to a desired modification in the fuel flow to said first nozzles.

13. In an internal combustion engine as recited in claim 9 wherein said distribution system further includes:

means for measuring an operational parameter of at least one piston in a bore to terminate the operation of said choke means when said operational parameter reaches a predetermined value.

14. In the internal combustion engine as recited in claim 13 wherein said means for measuring includes:

a thermostat for measuring the temperature of a coolant to provide said choke with a termination signal when the temperature reaches a preselected temperature.

15. In an internal combustion engine having a housing with a series of bores therein, each bore having an entrance port and an exhaust port, a piston for separating each bore into a supply chamber and an exhaust chamber, a transfer conduit for connecting each supply chamber with its corresponding combustion chamber, a manifold system connected to said supply chambers, a control valve associated with each supply chamber to allow air to flow into each supply chamber on movement of the piston toward the combustion chamber and to prevent the flow of fluid from each supply chamber on movement of said piston toward the supply chamber and a fuel distribution system for supplying fuel to each combustion chamber on movement of the piston toward the combustion chamber, said fuel distribution system being characterized by a nozzle for supplying each bore with fuel from a source without going through said control valve, said fuel and air being combined and communicated to said combustion chamber through said transfer conduit, each nozzle having a housing with a mixing chamber, each mixing chamber having an entrance port connected to the source of fuel, an exit port connected to said supply chamber, and an accumulator port connected to an accumulator, said accumulator being connected to said supply chamber to receive air from the supply chamber on movement of the piston toward the supply chamber, said mixing chamber receiving air from the accumulator and fuel from the source on movement of the piston in the bore toward the combustion chamber, said air entraining the fuel in the mixing chamber before flowing through the exit port into said supply chamber, said air in the supply chamber being combined with the air entrained fuel to create an air-fuel mixture for distribution to said combustion chamber.

16. In the internal combustion engine as recited in claim 15 wherein said distribution system further includes:

a fuel valve connected to said source of fuel and said manifold system, said fuel valve responding to the mass air flow through the manifold system for supplying each nozzle with a substantially identical quantity of fuel corresponding to an operator input.

17. In the internal combustion engine as recited in claim 16 wherein said distribution system further includes:

a choke having a housing with a cavity therein with an entrance port connected to said supply chambers and an exit port connected to said fuel valve; and a plunger located in said cavity, said plunger being moved from a first position where fluid communication through said cavity is interrupted to a second position where air from the supply chambers is communicated to said fuel valve to modify the effect of the mass air flow and allow an additional quantity of fuel to flow to the nozzles and increase the fuel-to-air ratio of the fluid mixture supplied to the combustion chambers.

18. In an internal combustion engine having a housing with a series of bores therein, each of said bores having an intake port, exhaust port and a transfer port therein, a piston located in each bore for separating a supply chamber from a combustion chamber located therein, a transfer conduit for connecting each supply chamber with a corresponding combustion chamber through said transfer port, a manifold system connected to each intake port, each piston on movement toward said combustion chamber opening said intake port to allow air to flow from said manifold system into said supply chamber while closing said exhaust and transfer ports and on movement toward said supply chamber closing said intake port to interrupt communication of air to said supply chamber while opening the exhaust port to allow exhaust gases to flow out of the combustion chamber and opening the transfer port to allow a fuel-air mixture to flow into the combustion chamber, the improvement comprising:

distribution means for presenting fuel from a source to each supply chamber, said distribution means including nozzles each of which has a first injector connected to a source of fuel and a mixing chamber and a second injector connected to said supply chamber, said mixing chamber receiving air from said supply chamber, said air in the mixing chamber being entrained with fuel transmitted from said first injector, said air entrained fuel flowing through said second injector into said supply chamber to create said fuel-air mixture, said fuel-air mixture flowing from said supply chamber to said combustion chamber by way of said transfer conduit.

19. In the internal combustion engine as recited in claim 18 wherein said distribution means further includes: an accumulator connected to each supply chamber and mixing chamber, said accumulator receiving air from each of said supply chambers to provide each mixing chamber with a substantially uniform volume of air to entrain the fuel transmitted from said first injector.

20. In the internal combustion engine as recited in claim 19 further including:

a pump responsive to an operational input for increasing the quantity of fuel supplied to each injector during a predetermined rate of acceleration and decreasing the quantity of fuel supplied to each injector during deceleration to achieve a substantially immediate response in the operation of the internal combustion engine.

21. In the internal combustion engine as recited in claim 20 further including:

choke means responsive to an operational parameter of said engine to modify the flow of fuel from said source to each injector to change the air-fuel ratio in the mixture.

22. In the internal combustion engine as recited in claim 21 wherein said operational parameter allows the internal combustion engine to achieve the greatest operational efficiency for a set air-fuel mixture.

23. In an internal combustion engine having a housing with a series of bores therein, each of said bores having an intake port, exhaust port and a transfer port therein, a piston located in each bore for separating a supply chamber from a combustion chamber located therein, a transfer conduit for connecting each supply chamber with a corresponding combustion chamber through said transfer port, a manifold system connected to each intake port, each piston on movement toward said combustion chamber opening said intake port to allow air to flow from said manifold system into said supply chamber while closing said exhaust and transfer ports and on movement toward said supply chamber closing said intake port to interrupt communication of air to said supply chamber while opening the exhaust port to allow exhaust gases to flow out of the combustion chamber and opening the transfer port to allow a fuel-air mixture to flow into the combustion chamber, the improvement comprising:

distribution means for presenting fuel from a source to said transfer conduit, said distribution means including a nozzle connected to each transfer conduit, each nozzle having a first injector connected to a source of fuel and a mixing chamber and a second injector connected to said transfer conduit, said mixing chamber receiving air from said supply chamber, said air from said supply chamber entraining fuel transmitted from said first injector into said mixing chamber, said air entrained fuel flowing through said second injector into said transfer tube and being combined with air flowing from said supply chamber in said transfer tube toward said transfer port to create said fuel-air mixture.

24. In the internal combustion engine as recited in claim 23 wherein said distribution means includes:

accumulator means connected to said supply chambers to receive air and to provide a substantially constant volume of air to said mixing chambers in establishing uniformity to said air entrained fuel supplied to said second injectors.

25. In the internal combustion engine as recited in claim 24 wherein said distribution means further includes:

means for modifying the quantity of fuel supplied to said injectors as a function of the rate of acceleration and deceleration to establish an immediate operational response in said engine.

26. In the internal combustion engine as recited in claim 25 wherein said means for modifying includes:

choke means connected to said manifold system for modifying the air flow therethrough to increase the fuel in the fuel-air mixture until a specified operational parameter of said engine is achieved.

* * * * *